US009992823B2

(12) United States Patent
Imm et al.

(10) Patent No.: US 9,992,823 B2
(45) Date of Patent: Jun. 5, 2018

(54) OVER-THE-RANGE MICROWAVE OVEN WITH AN INTEGRATED DUCT

(71) Applicant: Dongbu Daewoo Electronics Corporation, Seoul (KR)

(72) Inventors: Jun Hyuk Imm, Seoul (KR); Jong Jin Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 326 days.

(21) Appl. No.: 14/597,847

(22) Filed: Jan. 15, 2015

(65) Prior Publication Data

US 2016/0165673 A1 Jun. 9, 2016

(30) Foreign Application Priority Data

Dec. 5, 2014 (KR) ..... 10-2014-0174471

(51) Int. Cl.
*H05B 6/80* (2006.01)
*H05B 6/64* (2006.01)

(52) U.S. Cl.
CPC ..... *H05B 6/6423* (2013.01); *H05B 6/645* (2013.01); *H05B 6/6444* (2013.01); *H05B 6/6458* (2013.01)

(58) Field of Classification Search
CPC .. H05B 6/6444; H05B 6/6423; H05B 6/6458; H05B 6/645
USPC ..... 219/710, 757, 756, 681, 685, 716, 717, 219/723, 725, 738, 739, 746; 126/21 R, 126/21 A, 273 R, 197, 299 D, 299 R; 363/17, 19
See application file for complete search history.

(56) References Cited

U.S. PATENT DOCUMENTS

| | | | | |
|---|---|---|---|---|
| 2002/0084267 | A1* | 7/2002 | Kim | H05B 6/6423 219/757 |
| 2004/0134901 | A1* | 7/2004 | Jeong | H05B 6/6429 219/702 |
| 2008/0156793 | A1 | 7/2008 | Song et al. | |
| 2012/0170247 | A1* | 7/2012 | Do | H05B 6/6444 362/92 |

FOREIGN PATENT DOCUMENTS

| | | | |
|---|---|---|---|
| EP | 1220577 | A2 | 7/2002 |
| KR | 200189004 | | 7/2000 |
| KR | 100305047 | B1 * | 7/2001 |
| KR | 200232523 | | 9/2001 |
| KR | 20030063720 | A | 7/2003 |
| KR | 20040042931 | A | 5/2004 |
| KR | 20110063929 | A | 6/2011 |
| KR | 20130036415 | A * | 4/2013 |

* cited by examiner

*Primary Examiner* — Quang Van

(57) ABSTRACT

An over-the-range microwave oven that includes a duct unit configured to direct air from the back of the oven to the front and further includes an integrated duct module. The duct unit includes: a first panel at the bottom, a pair of second panels forming both lateral side surfaces of the duct unit. The integrated duct module is disposed on the first panel and integrates a plurality of electrical components, such as a power source unit, a running capacitor, a noise filter and a fuse.

11 Claims, 4 Drawing Sheets

OVER-THE-RANGE MICROWAVE OVEN WITH AN INTEGRATED DUCT

CROSS-REFERENCE TO RELATED APPLICATION

This application claims benefit and priority to Korean Patent Application No. 10-2014-0174471, filed on Dec. 5, 2014, with the Korean Intellectual Property Office, the disclosure of which is incorporated herein in its entirety by reference.

TECHNICAL FIELD

Embodiments of the present disclosure relate to over-the-range microwave ovens, and more particularly, to the layout of electrical components associated with the ventilation mechanisms on over-the-range microwave ovens.

BACKGROUND

In general, an over-the-range microwave oven refers to a microwave oven equipped with a venting system for exhauting air or fumes during cooking. An over-the-range microwave oven is usually mounted above a gas or electric range.

An over-the-range microwave oven combines a duct unit for discharging air and a cooking unit. Typically, the duct unit is associated with a plurality of electrical components, such as a power source, a running capacitor, a noise filter, a fuse, a humidity sensor, and the like. Conventionally, these components are spaced apart and distributed in different locations within the oven, which inevitably require long wires for electric connections.

The distributed design of the duct units make the oven interior configurations complicated, contributing to lengthy and cumbersome installation and assembling processes and thus high manufacturing cost.

SUMMARY

Embodiments of the present disclosure are directed to reducing assembly tolerance and manufacturing cost for over-the-range ovens, to improving space usage efficiency, and to reducing the overall size of the ovens.

An exemplary embodiment of the present disclosure provides an over-the-range microwave oven design including: an exterior housing; a cooking unit which is disposed in the housing; a duct unit which is disposed in the housing; a first panel forming a bottom wall of the duct unit; a pair of second panels forming both lateral side surfaces of the duct unit; and a duct module disposed on the first panel.

The duct unit may include an upper duct unit disposed between the housing and the cooking unit and located on an upper side of the cooking unit. The second panels may be disposed between the first panel and the housing and may have an increasingly smaller gap along the air flow. The duct module may be disposed outside the pair of second panels.

A third panel may be disposed in the rear of the pair of second panels and may have an air inlet hole.

The pair of second panels may include: a pair of first horizontal portions disposed on both sides of the third panel and in parallel with each other; a pair of inclined portions extending from the pair of first horizontal portions and has a gradually decreased gap; and a pair of second horizontal portions extending from the pair of inclined portions and in parallel to each other.

Moreover, the duct module may integrate: a power source unit disposed on the first panel outside one of the first horizontal portions; a running capacitor disposed on the first panel outside one of the inclined portions; a noise filter disposed on the first panel outside one of the second horizontal portions; and a fuse disposed on the first panel outside the other first horizontal portion.

Moreover, the duct module may further include a humidity sensor disposed on the first panel outside the other inclined portion and the other second horizontal portion.

Moreover, the over-the-range microwave oven may further include: a fourth panel which is disposed on the first panel. A symmetric region is defined by the combination of the fourth panel, the other inclined portion, and the other second horizontal portion. The humidity sensor is disposed in the defined region.

The over-the-range microwave oven may further include an air discharge unit disposed between the third panel and a rear surface of the housing and which allows air to flow to the duct unit.

The air discharge unit may include an air discharge motor, and one or more impellers. The third panel includes a first inlet hole and a second inlet hole. A first impeller is disposed on one side of the air discharge motor, allowing air to flow into the first inlet hole. A second impeller is disposed on the other side of the air discharge motor, allowing air to flow into the second inlet hole.

According to another embodiment, a method of using an over-the-range microwave oven includes: activating an air discharge unit; and discharging air, using the operated air discharge unit, around a gas or electric range or discharging air flowing by a drive unit of a microwave oven through an upper duct unit, which is disposed between a housing and a cooking unit and forming a flow path, and where the duct unit includes a first panel which is disposed at an upper side of the cooking unit, a pair of second panels which is disposed between the first panel and the housing and disposed symmetrically so that a distance therebetween decreases toward the front side, and a third panel which is disposed on the rear of the pair of second panels and has inlet holes into which air flows. The electric power from a power source unit disposed on the first panel is automatically shut off when the temperature reaches or exceeds a predetermined temperature as sensed by a fuse disposed on the first panel.

The present disclosure improves ventilation efficiency and air flow efficiency by improving the duct flow path. The duct module integrates the associated electrical components in a compact manner, which improves space usage efficiency of the oven, reduces assembly tolerance, improves manufacturing productivity, improves durability, and facilitates development of compact style over-the-range ovens.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
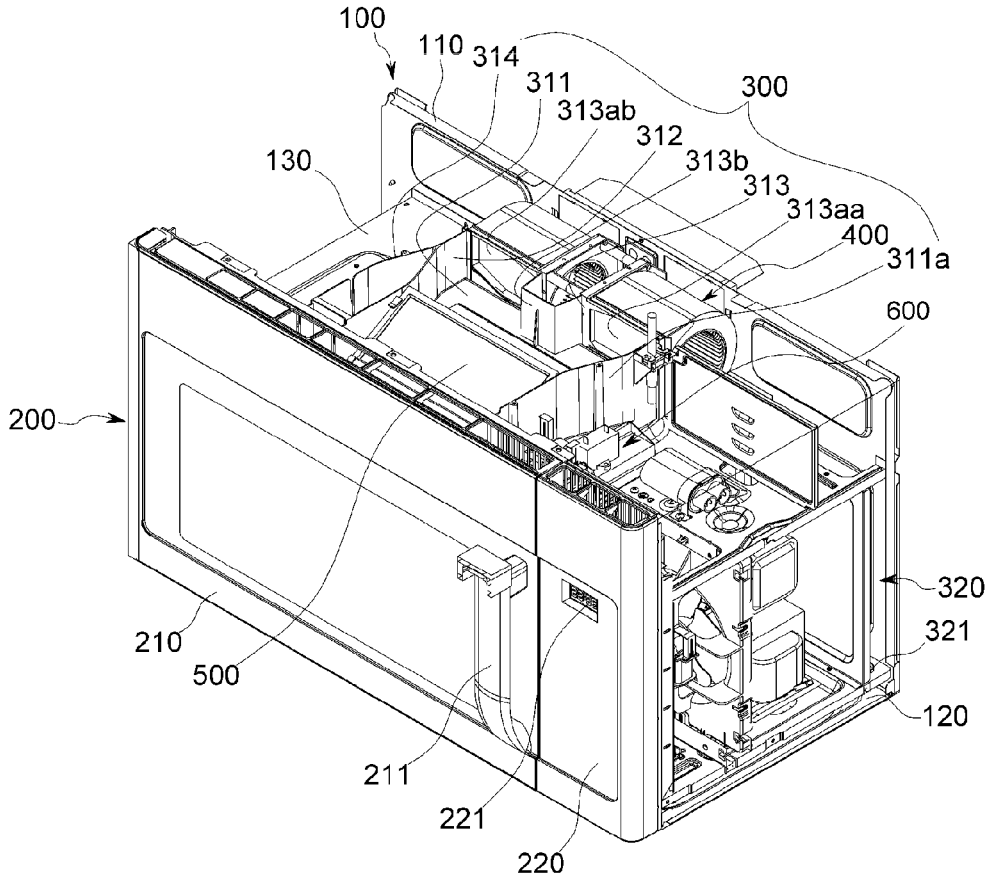
FIG. 1 illustrates an exemplary over-the-range microwave oven according to an embodiment of the present disclosure in which an upper housing and a lateral side housing are absent.

In the following detailed description, reference is made to the accompanying drawings, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings.

Unless particularly defined otherwise, all terms used in the present specification are the same as general meanings of the terms understood by those skilled in the art, and if the terms used in the present specification conflict with general meanings of the corresponding terms, the meanings of the terms comply with the meanings defined in the present specification.

However, the present disclosure, which is disclosed below, is intended to merely describe the exemplary embodiment of the present disclosure, but is not intended to limit the scope of the present disclosure, and like reference numerals designate like elements throughout the specification.

Figure 2:
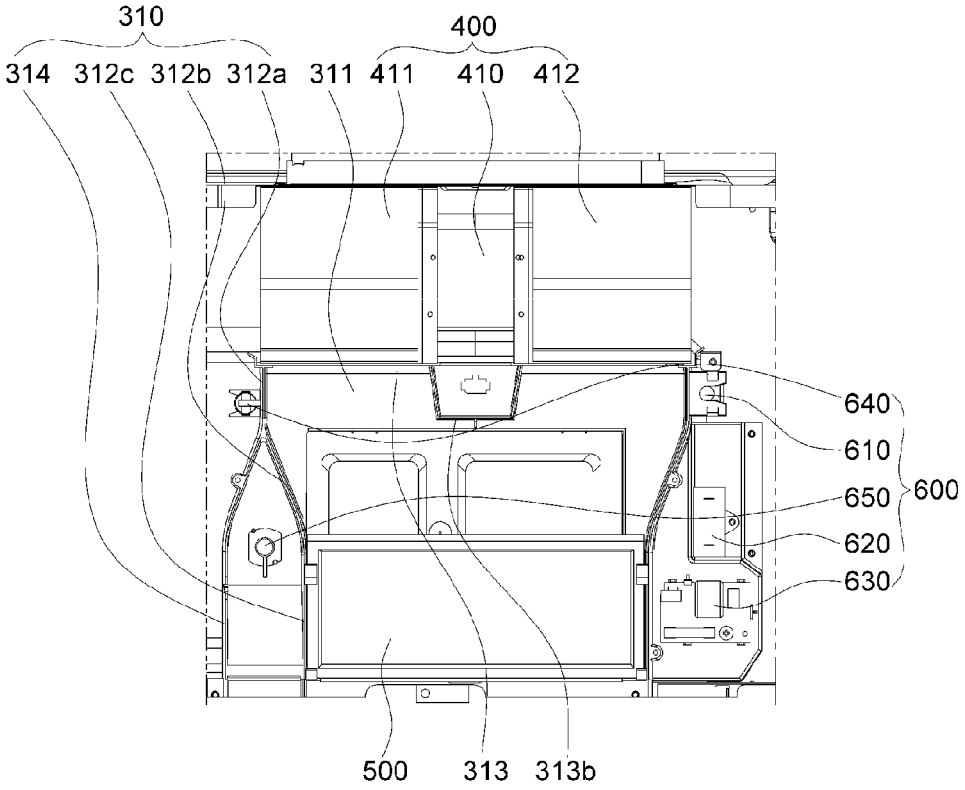
FIG. 2 illustrates a top view of FIG. 1.
Figure 3:
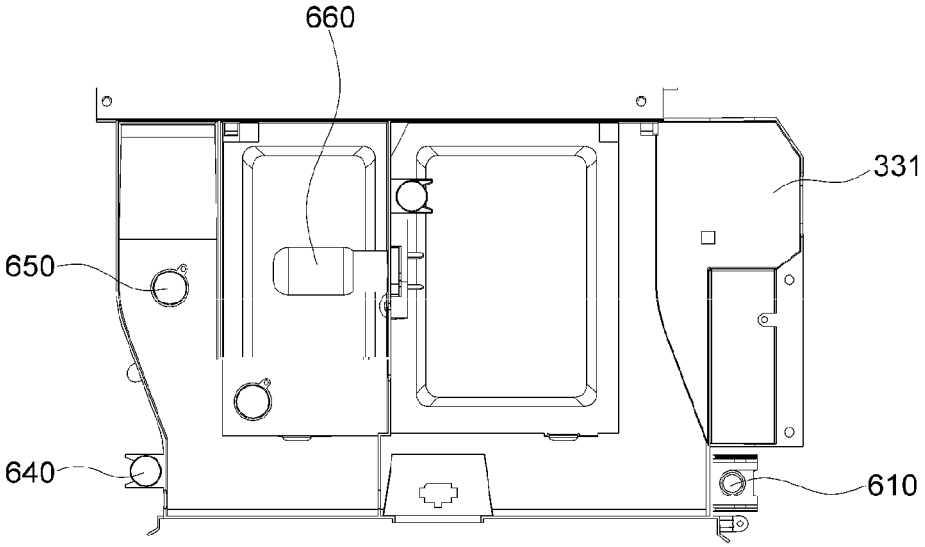
FIG. 3 illustrates an exemplary first panel according to an embodiment of the present disclosure when viewed from the lower side of the first panel.
Figure 4:
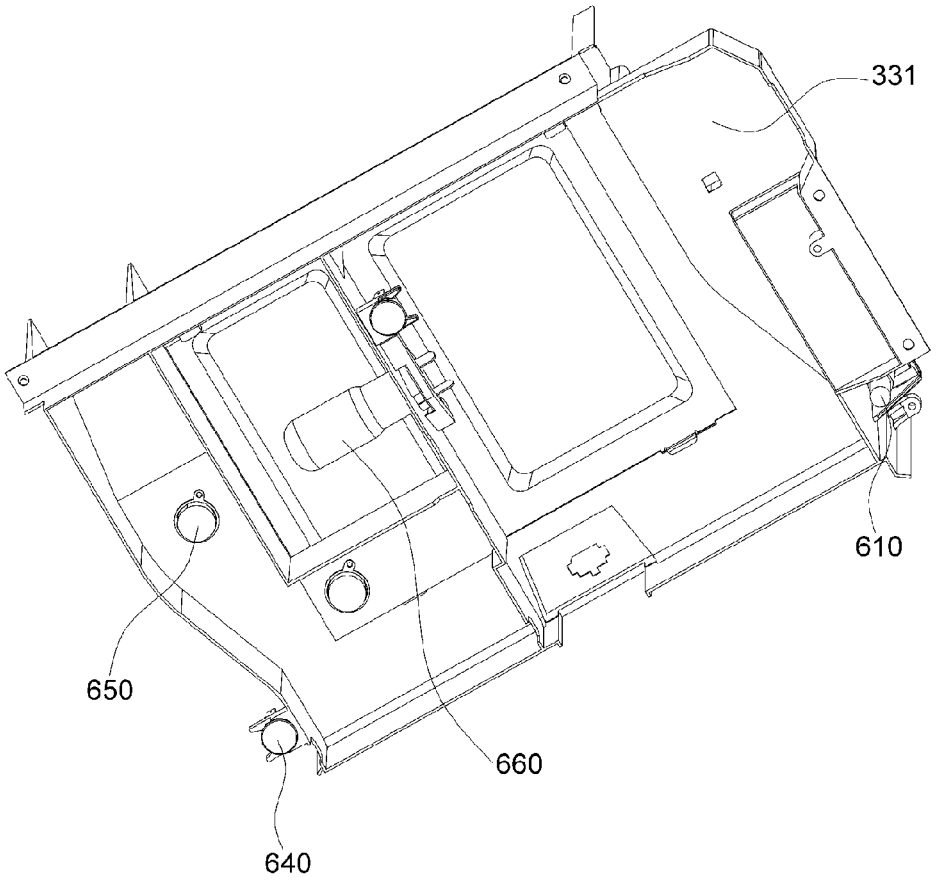
FIG. 4 illustrates a perspective view of the first panel in FIG. 3 when viewed from the lower side of the first panel.

FIG. 1 illustrates an exemplary over-the-range microwave oven according to an embodiment of the present disclosure in which an upper housing and a lateral side housing are absent. FIG. 2 illustrates a top view of FIG. 1. FIG. 3 illustrates an exemplary first panel according to an exemplary embodiment of the present disclosure when viewed from the lower side thereof. FIG. 4 illustrates a perspective view of the first panel in FIG. 3 when viewed from the lower side thereof.

Referring to FIGS. 1 and 2, the microwave oven includes a housing 100, a cooking unit 200, a duct unit 300, an air discharge unit 400, and a duct module 600, and a filter unit 500.

The housing 100 defines the exterior of the over-the-range microwave oven, and may be made of metal or non-metal. The housing 100 includes an upper housing and a lateral side housing, which are not illustrated, and a rear housing 110 and a lower housing 120. The respective housing members may be integrally formed or may be detachably coupled to each other.

The housing 100 may further include a partition wall 130 that vertically partitions the interior of the housing 100 into the cooking unit 200 and the duct unit 300. The partition wall 130 may be formed integrally with the housing 100, or may be fastened to the housing 100, e.g., by bolting.

The housing 100 may be formed as an outer wall of the duct unit 300 as described below.

The cooking unit 200 is disposed in the housing 100, and may include a cooking chamber and an electric equipment chamber.

The door 210 is disposed in the front of the cooking chamber. The door 210 may be hingedly coupled to the housing 100. A handle 211 may be disposed on the door 210 which allows a user to easily open and close the door 210. In addition, in order to allow the user to easily view the interior of the cooking chamber, the door 210 may further include a transparent window 212, e.g., made of tempered glass, etc.

The cooking unit 200 may include a control panel 220 disposed on one side of the door 210. The control panel 220 may include user input mechanisms (such as buttons, a touch panel, or a dial) to receive user commands to control the cooking unit 200. The control panel 220 may include a display unit 221 for presenting information to users related to the operations of the over-the-range microwave oven.

The control panel 220 may also include input mechanisms (e.g., buttons, a touch panel, or a dial) for users to control the duct unit 300 as described below.

The duct unit 300 may be disposed between the housing 100 and the cooking unit 200 and forms an air flow path. In this example, the duct unit 300 is divided into an upper duct unit 300 and a lateral side duct unit 320.

The lateral side duct unit 320 may be disposed between the cooking unit 200 and the lateral side housing (not illustrated) or between the control panel 220 and the lateral side housing (not illustrated). In this example, the housing 100 serves as an outer wall of the duct unit 300.

Here, the lateral side duct unit 320 includes a first inlet port 321 having an opening at the lower housing 120 for accepting air from the outside of the oven. The lateral side duct unit 320 also guides air flowing from the first inlet port 321 to the upper duct unit 310 as described below. A plurality of first inlet ports 321 may be formed.

Moreover, the upper duct unit 310 may be disposed on an upper side of the cooking unit 200, and may include a first panel 311, second panels 312, and/or a third panel 313. By use of the upper duct unit 310, an air discharge flow path (or the exhaust path) from the rear side toward the front side is formed. Thus, a range hood and an over-the-range microwave oven according to the present disclosure may advantageously reduce turbulent air flows, electric power consumption, and noise level.

The first panel 311 is disposed inside the housing 100 and forms the bottom wall of the upper duct unit. The first panel 311 is disposed above the partition wall 130. In addition, the first panel 311 may be integrally formed as an upper surface of the partition wall 130.

In addition, the first panel 311 includes second inlet ports 311*a* in the back, through which air flows from the lateral side duct unit 320 into the upper duct unit 300. The second inlet ports 311*a* may be respectively formed on two sides of the back of the first panel 311 and correspond to a first impeller 411 and a second impeller 412 which are described below.

The first panel 311 can be made of metal or plastic, for example.

Two second panels 312 are disposed as a pair between the first panel 311 and the housing 100 and form both lateral side surfaces of the upper duct unit, thereby partitioning the interior of the upper duct unit 310.

The pair of second panels 312 may be configured such that the gap therebetween gradually decreases along the air flow direction. More specifically, the pair of second panels 312 may be symmetrically disposed and the gap therebetween increasingly narrows toward the front side.

The pair of second panels 312 includes a pair of first horizontal portions 312*a* disposed on both sides of the third panel 313 (as described below) and in parallel to each other. The second panels 312 further include a pair of inclined portions 312*b* extending from first horizontal portions 312*a* and having an increasingly smaller gap. The second panels 312 further include a pair of second horizontal portions 312*c* extending from the inclined portions 312*b* and disposed in parallel to each other.

According to the present disclosure, the flow path has a symmetrical geometry and becomes narrower toward the front side. The flow path may advantageously improve flow efficiency of the exhaust air or fumes compared to the related art, and may reduce the noise level.

Here, a connecting surface between the first horizontal portion 312*a* and the inclined portion 312*b* (or a connecting surface between the inclined portion 312*b* and the second horizontal portion 312*c*) may be tapered or rounded, thereby forming an air discharge flow path offering enhanced ventilation efficiency.

The third panel 313 is disposed in the rear of the pair of second panels 312, and may have inlet holes 313*aa* and 313*ab* for air flow.

That is, referring to FIG. 3, in the air discharge flow path according to the exemplary embodiment, air may pass through the first inlet port 321, the second inlet ports 311*a* and to the impellers 411 and 412 (which are described below), and may flow into the inlet holes 313*aa* and 313*ab*. The air flow is then discharged to the outside through a flow path formed by the first panel 311, the second panels 312, and the upper cover 100.

The third panel 313 may include the first inlet hole 313*aa* directing to the first impeller 411, and the second inlet hole 313*ab* directing to the second impeller 412, thereby effectively enhancing the various air flows.

The third panel 313 may further include a bent portion 313*b* formed between the first inlet hole 313*aa* and the second inlet hole 313*ab* and protruding forward, thereby further enhancing the various air flows.

To prevent the formation of turbulence, the bent portion 313*b* increasingly narrows toward the front side. For example, the bent portion 313*b* may have a trapezoidal shape.

The air discharge unit 400 is disposed between the third panel 313 and a rear surface of the housing 100, and allows air to flow into the inlet holes 313*aa* and 313*ab*. More specifically, the air discharge unit 400 may include an air discharge motor 410. The impellers 411 and 412 are driven by the air discharge motor 410 and operate to allow air to flow into the inlet holes 313*aa* and 313*ab*.

Here, the first impeller 411 is disposed on one side of the air discharge motor 410. The second impeller 412 is disposed on the other side of the air discharge motor 410. Both ends of the first impeller 411 and the second impeller 412 are disposed proximate to second inlet ports 311*a*, respectively, thereby allowing air to be pumped from the outside to the inside of the housing 100, to the first panel 311, and to the second panels 312.

According to embodiments of the present disclosure, because the upper duct unit 310 is configured to be narrower toward the front side as described above, the functional components associated with the duct unit 300 may be arranged in a compact manner as a duct module 600.

Here, the duct module 600 may be disposed on the first panel 311 and include a power source unit 610, a running capacitor 620, a noise filter 630, and a fuse 640. The module 600 further includes the humidity sensor 650 and/or the lighting unit 660.

The power source unit 610 can be connected to wall power and distribute electric power for operating the cooking unit 200 or the duct unit 300. The power source unit 610 may be disposed on the first panel 311 located outside one of the first horizontal portions 312*a*.

The running capacitor 620 (also commonly referred to as a "starting condenser") is used to provide the initial power for activating the air discharge motor 410. The running capacitor 620 may be disposed on the first panel 311 outside one of the inclined portions 312*b*.

The noise filter 630 serves to reduce noise caused by the operating air discharge motor 410, and to provide related signals. The noise filter 430 may be disposed on the first panel 311 located outside one of the second horizontal portions 312*c*.

The fuse 640 serves to cut off the electric power supplied from the power source unit 610 when the cooking unit 200 or the air discharge motor 410 become overheated (for example, about 90° C. or 150° C.). The fuse 640 may be disposed on the first panel 311 outside the other first horizontal portion 312*a*.

The humidity sensor 650 senses humidity or senses the temperature of water vapor generated from food being cooked in the cooking unit 200. Accordingly, the humidity sensor transmits a signal to a control unit (not illustrated) to control the cooking unit 200 or generates a signal for turning on and off the air discharge motor 410.

The humidity sensor 650 may be disposed on the upper side of the cooking unit 200. The duct module 600 may be disposed on the first panel 311 outside the other inclined portion 312*b* and the other second horizontal portion 312*c*.

To facilitate the humidity sensor 650 functioning properly, the microwave oven may further include a fourth panel 314 disposed on the first panel 311. The combination of the fourth panel 314, the other inclined portion 312*b*, and the other second horizontal portion 312*c* define a symmetric region. The humidity sensor 650 may be disposed within this region.

Referring to FIGS. 3 and 4, the lighting unit 660 is disposed on a lower surface of the first panel 311, and allows the user to observe the interior of the cooking unit 200 without opening the door.

Because the components associated with operating the duct unit are modularized and integrated onto the first panel 311, the related assembly tolerance is advantageously reduced, which can improve manufacturing productivity. The reduced assembly tolerance requirements may also facilitate development of over-the-range microwave ovens of smaller sizes.

The filter unit 500 may be disposed on the front side of the pair of second panels 312, and more specifically, on the second horizontal portion 312*c*. The filter unit 500 may be a charcoal filter and can serve to filter air before it is discharged outside. The filter unit 500 may be detachable.

An exemplary method of using the over-the-range microwave oven design according to an embodiment of the present disclosure will be described below.

First, the air discharge unit 400 is activated when a user provides input through the input means associated with the microwave oven, e.g., the buttons, the touch panel, or the dial disposed on the control panel 220.

Then, the air discharge motor 410 is activated once the external electric power is supplied. The motor 410 drives the impellers 411 and 412 to rotate, and thereby the outside air is drawn to the oven from the first inlet port 321 of the lateral side housing. The drawn air flows into the impellers 411 and 412 through the second inlet ports 311 disposed on the first panel 311.

Thereafter, air flow exits the impellers 411 and 412 at a high speed and enters into a duct through the inlet holes 313*aa* and 313*ab* of the third panel 313. The duct is formed by the housing 100, the first panel 311, and the second 312.

In this example, the bent portion 313*b* formed on the third panel 313 guides the air flow toward the front side and can advantageously prevent the formation of turbulent flow from air exiting the impellers 411 and 412. Because the second panels 312 have a symmetric geometry and form an increasingly narrower gap, air flow can be quickly discharged to the outside.

The filter is disposed between the second horizontal portions 312*c* and at the narrowest location of the flow path, thereby effectively capturing and filtering contaminants.

That is, by the operation of the air discharge unit 400, hot air or fumes around a gas or electric range may be discharged or air flowing by a drive unit of a microwave oven may be discharged through the upper duct unit 300. The upper duct unit 300 is disposed between the housing 100 and the cooking unit 200 and serves as a flow path. The upper duct unit includes the first panel 311 disposed on the upper side of the cooking unit 200, the pair of second panels 312 disposed between the first panel 311 and the housing 100. The second panels are disposed symmetrically and a gap therebetween decreases toward the front side. The upper duct unit 300 further includes the third panel 313 disposed in the rear of the pair of second panels 312 and having the inlet holes 313*aa* and 313*ab* for air flow.

Embodiments of the present disclosure employ an air discharge unit 400 disposed on the rear side and configured to guide air from the rear side toward the front side. The air discharge unit 400 includes a symmetric flow path which is increasingly narrower toward the discharge port to further increase the aforementioned effects.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An over-the-range microwave oven comprising:

a housing defining an exterior;

a cooking unit disposed in the housing;

a duct unit disposed in the housing;

a first panel forming a bottom surface of the duct unit;

a pair of second panels disposed on two sides of the first panel and forming lateral side surfaces of the duct unit;

a third panel disposed on the rear of the pair of second panels and comprising an air inlet hole; and an integrated duct module disposed on the first panel and comprising a plurality of electrical components associated with the duct unit, wherein the duct unit comprises: an upper duct unit disposed between the housing and the cooking unit and disposed on an upper side of the cooking unit, wherein the pair of second panels are disposed between the first panel and the housing, wherein an interval gap between the pair of second panels decreases along an air flow direction, wherein the duct module is disposed outside the pair of second panels, and wherein the third panel comprises a first inlet hole and a second inlet hole, and further comprises on the first panel a bent portion protruding forward between the first inlet hole and the second inlet hole.

2. The over-the-range microwave oven of claim 1, wherein the pair of second panels comprise:

a pair of first horizontal portions respectively disposed on both sides of the third panel and in parallel to each other;

a pair of inclined portions respectively extending from the pair of first horizontal portions, wherein a gap between the pair of inclined portions gradually decreases; and a pair of second horizontal portions respectively extending from the pair of inclined portions and disposed in parallel to each other.

3. The over-the-range microwave oven of claim 2, wherein the integrated duct module comprises:

a power source unit disposed on the first panel outside one of the pair of first horizontal portions;

a running capacitor disposed on the first panel outside one of the pair of inclined portions;

a noise filter disposed on the first panel outside one of the pair of second horizontal portions; and a fuse disposed on the first panel outside another one of the pair of first horizontal portions.

4. The over-the-range microwave oven of claim 2, wherein the integrated duct module comprises a humidity sensor disposed on the first panel outside another one of the pair of inclined portions and another one of the pair of second horizontal portions.

5. The over-the-range microwave oven of claim 4 further comprising:

a fourth panel disposed on the first panel, wherein a region formed by a combination of the fourth panel, the another one of the pair of inclined portions, and the another one of the pair of second horizontal portions is symmetric, and wherein the humidity sensor is disposed within the region.

6. The over-the-range microwave oven of claim 2, wherein the integrated duct module further comprises a lighting unit disposed on a lower surface of the first panel.

7. The over-the-range microwave oven of claim 2 further comprising an air filter disposed on the pair of second horizontal portions.

8. The over-the-range microwave oven of claim 1, wherein the pair of second panels are disposed symmetrically to each other.

9. The over-the-range microwave oven of claim 1, further comprising:

an air discharge unit disposed between the third panel and a rear surface of the housing, where the air discharge unit is configured to drive air into the duct unit.

10. The over-the-range microwave oven of claim 9, wherein the air discharge unit comprises an air discharge motor and an impeller assembly driven by the air discharge motor, and wherein the impeller assembly is configured to pump air into the duct unit.

11. The over-the-range microwave oven of claim 10, wherein the impeller assembly comprises: a first impeller disposed on a first side of the air discharge motor and configured to pump air through the first inlet hole; and a second impeller disposed on a second side of the air discharge motor and configured to pump air through the second inlet hole.

* * * * *